United States Patent [19]

Lee

[11] Patent Number: 4,834,248

[45] Date of Patent: May 30, 1989

[54] BELT HANGER

[76] Inventor: Tak W. J. B. Lee, 65 Spring Garden Avenue, Apt. #606, Willowdale, Ontario, Canada, M2N 6H9

[21] Appl. No.: 182,125

[22] Filed: Apr. 15, 1988

[51] Int. Cl.[4] ..... A47F 5/08

[52] U.S. Cl. ..... 211/13; 211/113; 248/302

[58] Field of Search ..... 248/302, 303, 309.1, 248/309.2; 211/113, 57.1, 59.1, 88, 119, 13, 54.1, 60.1; 223/85, 88; D6/315, 317, 320, 323, 327

[56] References Cited

U.S. PATENT DOCUMENTS

| | | | |
|---|---|---|---|
| D. 92,695 | 7/1934 | Bear | D6/320 |
| D. 168,264 | 11/1952 | Homola | D6/315 |
| D. 220,271 | 3/1971 | Miles | D6/230 |
| D. 281,931 | 12/1985 | Arnold | D6/317 |
| D. 291,031 | 7/1987 | Luongo | D6/323 |
| D. 295,344 | 4/1988 | Pryor | D6/317 |
| 3,187,902 | 6/1965 | Nelson | 211/70.6 |
| 3,297,168 | 1/1967 | Fleming | 248/316.7 |
| 3,349,922 | 10/1967 | Morrison | 211/113 |
| 4,429,797 | 2/1984 | Collins | 211/119 |

FOREIGN PATENT DOCUMENTS

| | | | |
|---|---|---|---|
| 678471 | 3/1966 | Belgium | 211/119 |
| 1416634 | 12/1975 | United Kingdom | 211/13 |

*Primary Examiner*—Ramon O. Ramirez
*Assistant Examiner*—Robert A. Olson

[57] ABSTRACT

The present invention provides a hanger member for hanging belts and comprising a pair of rigid parallel supporting arms having upturned forward ends and being opened between the forward ends allowing access to belt fitting between the supporting arms. The supporting arms are spaced from one another by a distance at least as great as the thickness of a standard belt strap and less than the thickness of a standard belt buckle.

4 Claims, 5 Drawing Sheets

BELT HANGER

FIELD OF THE INVENTION

The present invention relates to a hanger member specifically designed for the hanging of belts.

BACKGROUND OF THE INVENTION

Presently available belt hangers are in the form of hooks designed to fit through a belt buckle. However, over the last few years belt buckles themselves have changed from an open looped style with movable belt catch to a much more closed style with a fixed belt catch. The new style of belt buckle does not have anything in the way of an opening great enough to receive a standard belt hanger hook thereby necessitating a new design in belt hangers.

SUMMARY OF THE PRESENT INVENTION

The present invention provides a hanger member for hanging belts by their buckles whether they be of the old open looped style or the new more closed style buckle. The hanger member of the present invention comprises a pair of at least substantially parallel supporting arms having upturned forward ends and being open between the forward ends for allowing belt fitting in the hanger member. The arms of the hanger member are spaced from one another by a distance at least as great as the thickness of a standard belt strap and less than the thickness of a standard belt buckle for hanging of the belt.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
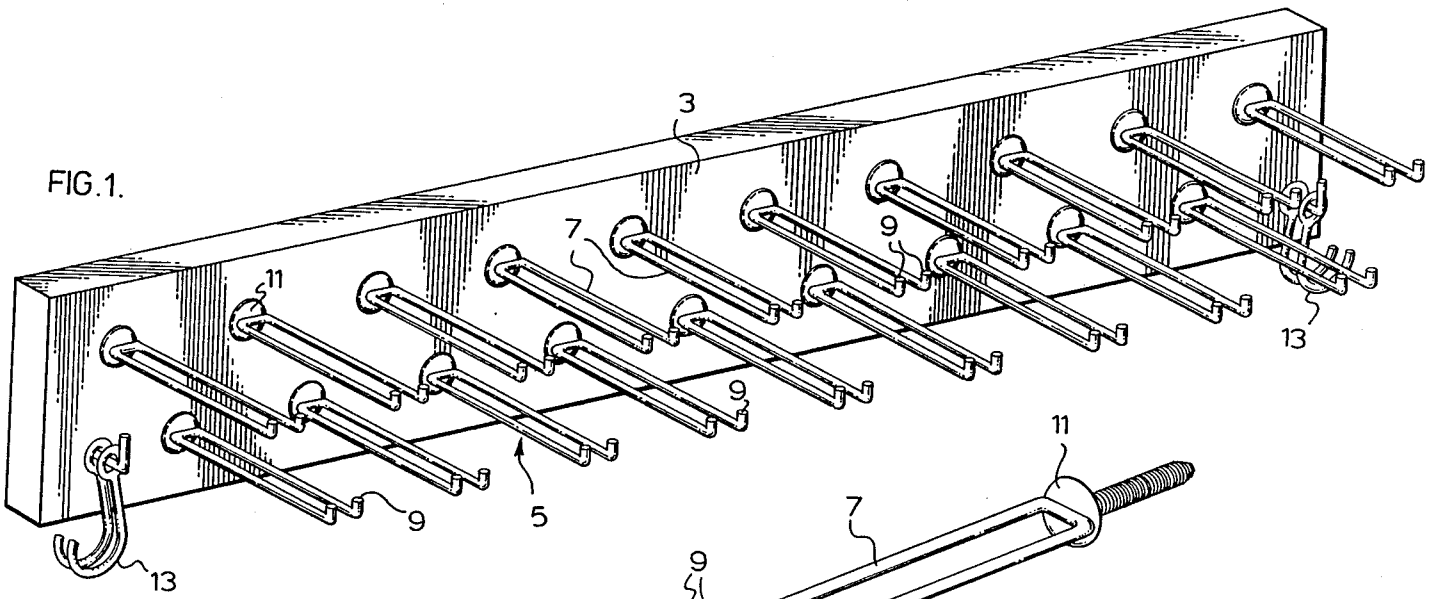
FIG. 1 is a perspective view of a belt hanger with a plurality of hanger members according to a preferred embodiment of the present invention.
Figure 2A:
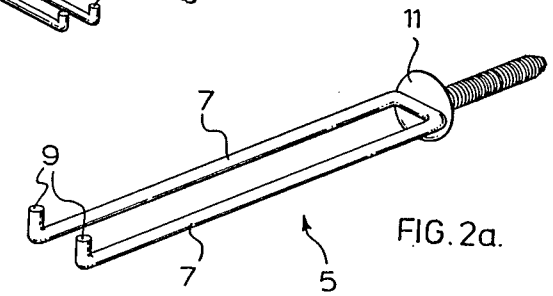
FIG. 2*a* is a perspective view of one of the individual hanger members from the belt hanger of FIG. 1.
Figure 2:
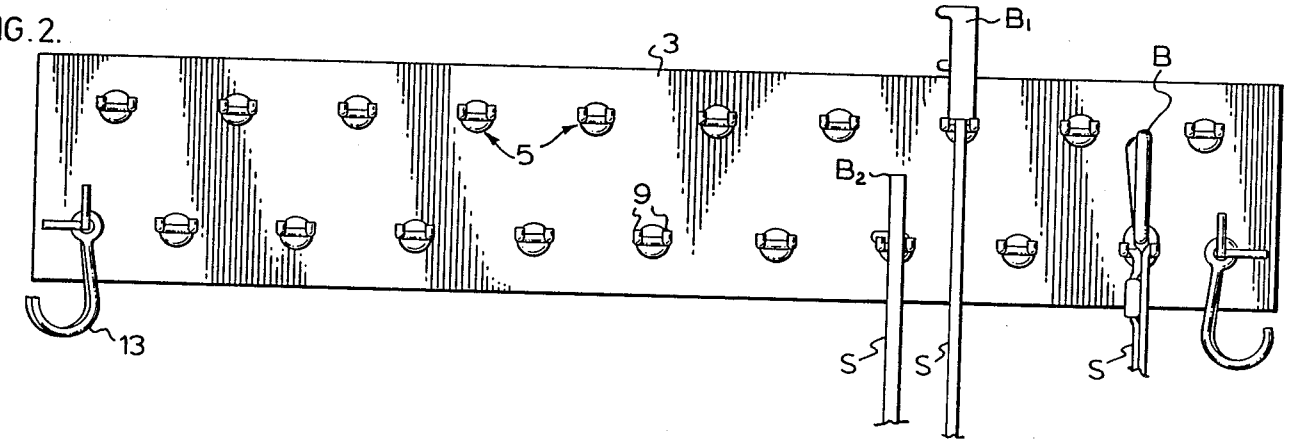
FIG. 2 is a side view of the belt hanger of FIG. 1.

FIGS. 1 and 2 show a belt hanger generally indicated at 1. This type of hanger includes a base support 3 for mounting to a wall or the like and a plurality of individual hanger members 5 supported on the base. FIG. 2*a* shows the construction of each of the hanger members formed by a pair of parallel arms 7 having upturned forward ends 9. The arms 7 are separated from one another preferably by about $\frac{1}{4}$ inch to allow the fitting of a standard belt strap but not to allow the belt buckle to fall down between the arms. The forward upturned ends of the arms help to ensure that the belts are not inadvertently pulled out between the arms.

Figure 3:
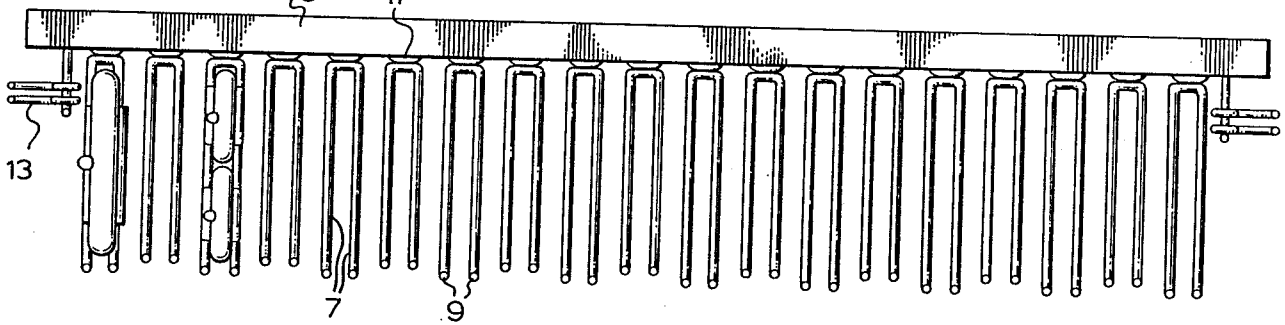
FIG. 3 is a top plan view of the belt hanger of FIG. 1.

The length of the arms is anywhere from about 2 to 3 inches allowing, in some cases, the fitting of two side by side belts in the hanger member as seen in FIG. 3. FIG. 3 also shows the fitting of one very wide belt such as a womens high fashion belt.

Hanger member 5 is also formed as seen in FIG. 2*a* with a rearwardly projecting self tapping screw 11. The forwardly projecting arms provide a finger grip or leverage for twisting screw 11 into support 3.

Provided to one end of the support is a further set of hooks 13. These hooks can be used to receive different articles of clothing or the like.

In FIG. 2 it will be seen how adjacent hanger members 5 are set in an alternating up/down pattern. This, as shown in the right hand side of the Figure, allows side by side belts comprising standard looped buckles B and straps S to be hung without interference between the two belt buckles placed at different heights on the hanger. Also at the left hand side of FIG. 2 is seen one of the newer style belts having again a strap S and a belt buckle B1. This belt buckle, rather than being formed with an open loop, has a solid body and a tooth-like projection for fitting in one of the holes of the belt. In a third example, a womens belt having a buckle-like toothed part B2 is hung directly by the tooth. Note that in all cases, the supporting arms 7 are spaced far enough apart to allow fitting of the belt strap S without allowing the belt buckles either B or B1 or belt tooth B2 to fall through the supporting arms. FIG. 3 further shows to the left hand side of the Figure how two belts can be hung in a single hanger bracket. Note that once again the upturned ends 9 will help to prevent the belt buckles from being inadvertently pulled out of their hanger members particularly as belts are removed to either side of them.

Figure 4:
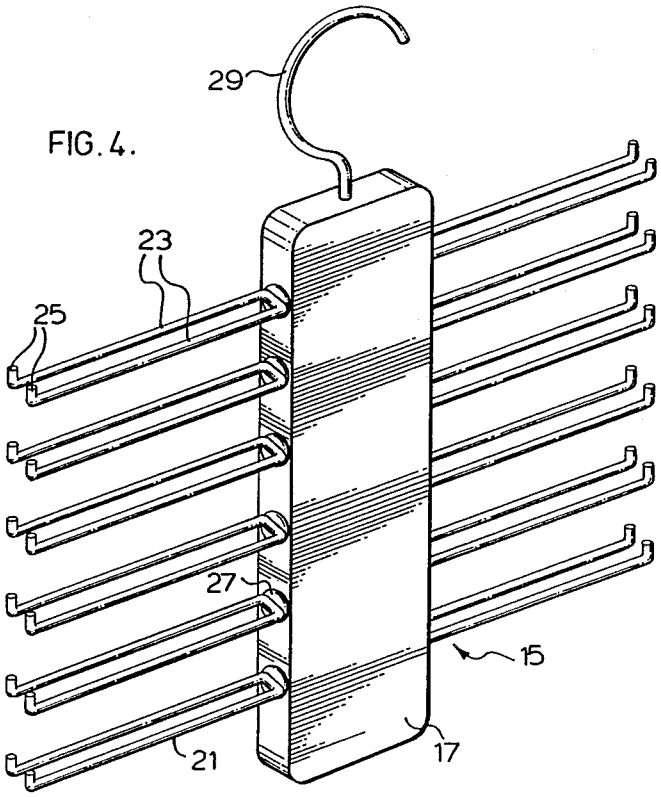
FIG. 4 is a perspective view of a different belt hanger according to a further preferred embodiment of the present invention.
Figure 6:
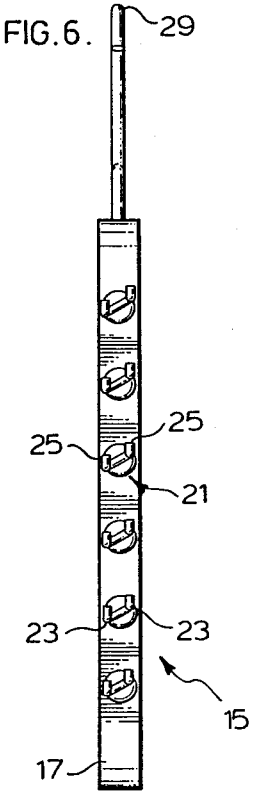
FIG. 6 is an end view of the belt hanger of FIG. 4.
Figure 5:
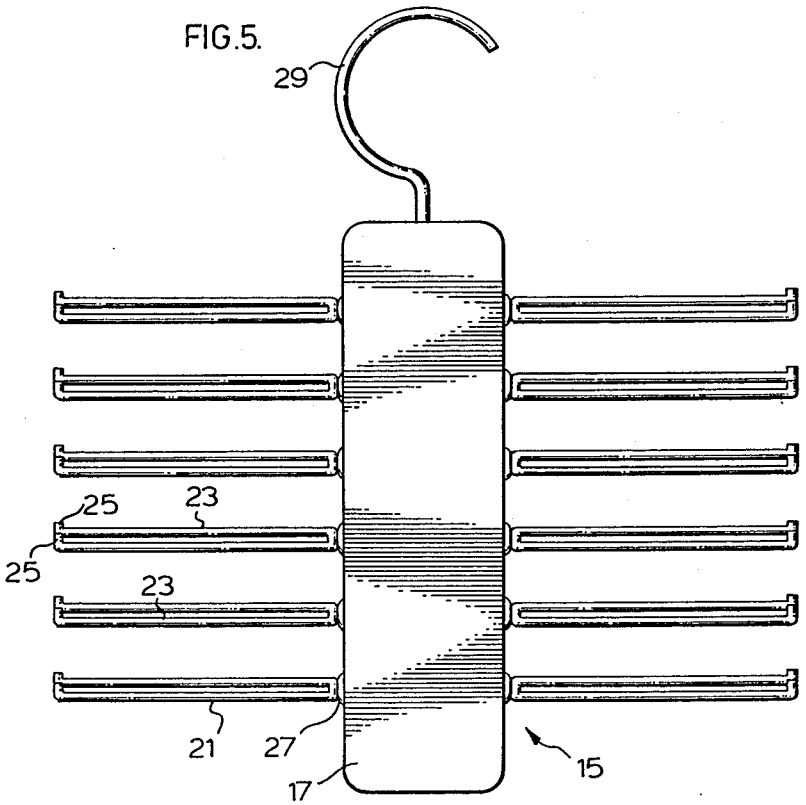
FIG. 5 is a side view of the hanger of FIG. 4.

FIGS. 4 through 6 show a modified belt hanger 15 somewhat differentfrom the belt hanger shown in FIGS. 1 through 3. This particular belt hanger includes a plurality of individual hanger members 21 extending out to either side of a supporting base 17. The hanger members on each side of the supporting base are in vertical alignment with one another. Belt hanger 15 further includes a supporting hook 29 for hanging it in a closet or the like.

Referring more particularly to FIG. 4, each of the hanger members 21 again includes a pair of parallel supporting arms 23 terminating in upstanding ends 25. However, in this case as best seen in FIGS. 5 and 6 supporting arms 23 are vertically offset from one another making them easier to load in view of the vertical stacking of the individual hanger members, i.e. since the arms in each hanger member are vertically offset, the belts hanging therein are directed sideways off of the vertical line of the hanger members, providing a top clearance immediately above each of the hanger members below the uppermost hanger member.

Figure 7:
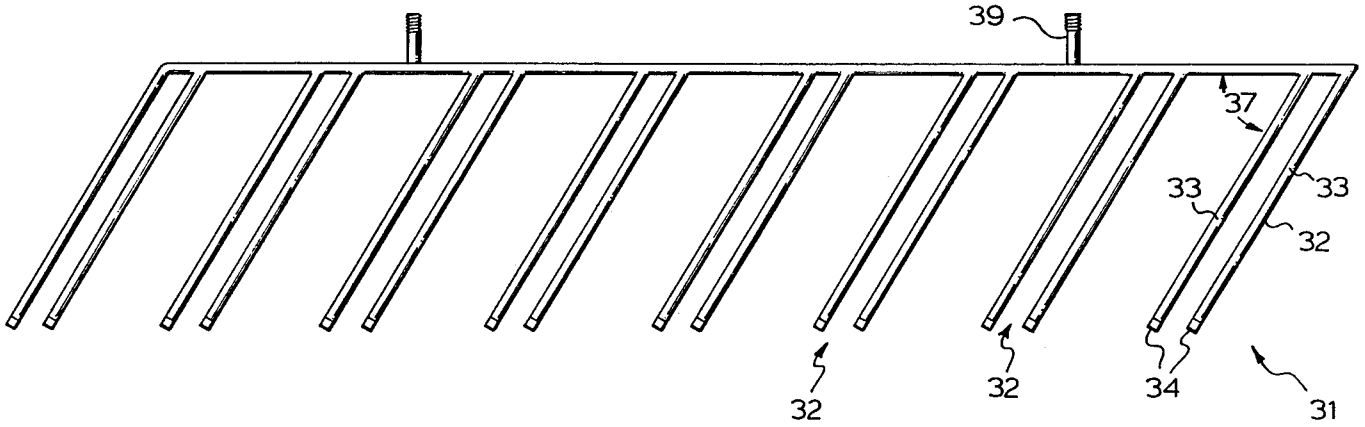
FIG. 7 is a top view of still another belt hanger according to a further preferred embodiment of the invention.

FIG. 7 shows still a further arrangement for a belt hanger generally indicated at 31. This belt hanger has a unitary construction comprising a plurality of individual hanger members 32 each formed from parallel supporting arms 33 having upturned ends 34. All of the hanger members 32 feed off of a common supporting rod or bar 35 which can either be mounted to a supporting back board or be provided with bolt like extensions 39 for bolting to a separate mounting surface. This particular belt hanger is particularly suited for mounting to the inside of a cupboard door or the like where there is limited depth and in order to accomodate for that limited depth each of the hanger members 32 is set at an angle 37 relative to the main bar 35. Therefore, even though supporting arms 33 are once again of a 2 to 3 inch length, because of their angling they extend inwardly from their supporting surface by a distance substantially less than 2 to 3 inches, e.g. supporting arms 33 having a 3 inch length might only exceed inwardly by about 2 inches depending upon the degree of angle 37.

A further feature of all of the hanger members described above is the open front end, i.e. the opening between the hanger arms enabling belt insertion from the front as well as from above the hangers. This is particularly important for the hanging of double buckle belts with a buckle at each end which would not fit into a closed ended hanger.

It will now be seen from the description above how a belt hanger built in accordance with the present invention and in particular a hanger member for that belt hanger while being simple in design is extremely efficient in operation. In addition, it is to be understood that other types of "belts" such as suspenders and the like can equally as well be fitted into the belt hanger.

Although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A hanger member independent of and usable with a support for hanging belts, said hanger member comprising a pair of at least substantially parallel rigid supporting arms having upturned forward ends and being open between said forward ends, and further having rear ends connected by a cross member, said cross member being provided with a rearwardly projecting threaded member for threaded engagement with the support, said arms being spaced from one another by a distance at least as great as the thickness of a standard belt strap and less than the thickness of a standard belt buckle.

2. A hanger member as claimed in claim 1, wherein said supporting arms are vertically offset and parallel with one another.

3. A hanger member independent of and usuable with a support surface for hanging a plurality of belts, said hanger member comprising a plurality of pairs of at least substantially parallel rigid supporting arms having upturned forward ends and being open between said forward ends, the arms in each of said pairs being connected with one another by a cross member which extends between said plurality of pairs of supporting arms, said cross member being provided with a rearwardly projecting threaded member for threaded engagement with the support, said arms in each of said pairs being spaced from one another by a distance at least as great as the thickness of a standard belt strap and less than the thickness of a standard belt buckle.

4. A hanger member as claimed in claim 3, wherein the arms in each of said pairs have a fixed length, and wherein said arms have an outward extension at an angle from said cross member such that said outward extension is less than said fixed length of said arms.

* * * * *